US012043507B2

(12) United States Patent
Aono

(10) Patent No.: US 12,043,507 B2
(45) Date of Patent: Jul. 23, 2024

(54) SHEET FEED APPARATUS AND IMAGE FORMING APPARATUS

(71) Applicant: KYOCERA Document Solutions Inc., Osaka (JP)

(72) Inventor: Shinya Aono, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 111 days.

(21) Appl. No.: 17/856,818

(22) Filed: Jul. 1, 2022

(65) Prior Publication Data

US 2023/0010982 A1 Jan. 12, 2023

(30) Foreign Application Priority Data

Jul. 6, 2021 (JP) ..... 2021-112120

(51) Int. Cl.

| | |
|---|---|
| ***B65H 3/60*** | (2006.01) |
| ***F24H 3/02*** | (2022.01) |
| ***F24H 15/208*** | (2022.01) |
| ***F24H 15/238*** | (2022.01) |

(52) U.S. Cl.

CPC ..... *B65H 3/60* (2013.01); *F24H 3/02* (2013.01); *F24H 15/208* (2022.01); *F24H 15/238* (2022.01)

(58) Field of Classification Search

CPC .... B65H 3/48; B65H 3/60; F24H 3/02; F24H 15/208; F24H 15/238

USPC ..... 271/309

See application file for complete search history.

(56) References Cited

U.S. PATENT DOCUMENTS

| | | | | |
|---|---|---|---|---|
| 7,419,152 | B2 * | 9/2008 | Adachi | B65H 3/48 271/31 |
| 7,657,199 | B2 * | 2/2010 | Nishikawa | G03G 15/1675 399/101 |
| 7,883,084 | B2 * | 2/2011 | Okumura | B65H 3/60 271/97 |
| 7,891,654 | B2 * | 2/2011 | Izumichi | B65H 3/0607 271/30.1 |
| 7,938,396 | B2 * | 5/2011 | Okumura | B65H 3/0607 271/130 |
| 8,152,159 | B2 * | 4/2012 | Okumura | B65H 3/0607 271/118 |
| 8,712,279 | B2 * | 4/2014 | Ueno | B65H 3/48 271/97 |
| 2006/0175746 | A1 | 8/2006 | Adachi | |

FOREIGN PATENT DOCUMENTS

JP 2006213490 A 8/2006

* cited by examiner

*Primary Examiner* — Leslie A Nicholson, III

(74) *Attorney, Agent, or Firm* — Alleman Hall & Tuttle LLP

(57) ABSTRACT

A sheet feed apparatus includes a sheet feed cassette, an air blowing device, and an air blowing control portion. The air blowing device blows warm air to a sheet stack in the sheet feed cassette. The air blowing control portion controls the air blowing device to adjust an air volume and a temperature of the warm air. The air blowing control portion adjusts the air volume and the temperature of the warm air in accordance with the amount of sheets in the sheet feed cassette.

5 Claims, 4 Drawing Sheets

FIG.3

| WARM AIR CONTROL VARIABLE | HEATER DUTY(%) | AIR VOLUME (%) | AIR TEMPERATURE INDEX |
|---|---|---|---|
| 0~2 | 50 | 100 | 5 |
| 4 | 50 | 90 | 10 |
| 6 | 50 | 80 | 15 |
| 8 | 50 | 70 | 20 |
| 10 | 50 | 60 | 25 |
| 12 | 50 | 50 | 30 |
| 14 | 50 | 40 | 35 |
| 16 | 50 | 30 | 40 |
| 18 | 50 | 20 | 45 |
| 20 | 50 | 10 | 50 |
| 22 | 100 | 100 | 55 |
| 24 | 100 | 90 | 60 |
| 26 | 100 | 80 | 65 |
| 28 | 100 | 70 | 70 |
| 30 | 100 | 60 | 75 |
| 32 | 100 | 50 | 80 |
| 34 | 100 | 40 | 85 |
| 36 | 100 | 30 | 90 |
| 38 | 100 | 20 | 95 |
| 40 OR MORE | 100 | 10 | 100 |

SHEET FEED APPARATUS AND IMAGE FORMING APPARATUS

INCORPORATION BY REFERENCE

This application is based upon and claims the benefit of priority from the corresponding Japanese Patent Application No. 2021-112120 filed on Jul. 6, 2021, the entire contents of which are incorporated herein by reference.

BACKGROUND

The present disclosure relates to a sheet feed apparatus and an image forming apparatus.

A sheet feed apparatus blows warm air to a stack of sheets. The purpose of this is to suppress failure in sheet feeding caused by loaded sheets sticking to each other. Further, this sheet feed apparatus determines the temperature of the warm air based on the sheet type, humidity, and temperature.

SUMMARY

A sheet feed apparatus according to one aspect of the present disclosure includes an air blowing device and an air blowing control portion. The air blowing device blows warm air to a sheet stack in a sheet feed cassette. The air blowing control portion controls the air blowing device to adjust an air volume and a temperature of the warm air. The air blowing control portion adjusts the air volume and the temperature of the warm air in accordance with an amount of sheets in the sheet stack.

An image forming apparatus according to another aspect of the present disclosure includes the sheet feed apparatus and a print engine. The sheet feed apparatus feeds one sheet at a time from the sheet stack in the sheet feed cassette to a conveying path. The print engine prints an image on the sheet conveyed through the conveying path.

This Summary is provided to introduce a selection of concepts in a simplified form that are further described below in the Detailed Description with reference where appropriate to the accompanying drawings. This Summary is not intended to identify key features or essential features of the claimed subject matter, nor is it intended to be used to limit the scope of the claimed subject matter. Furthermore, the claimed subject matter is not limited to implementations that solve any or all disadvantages noted in any part of this disclosure.

BRIEF DESCRIPTION OF THE DRAWINGS

FIG. 3 shows an example of a table showing a correspondence relationship between the value of the warm air control variable, the heat amount, and the air volume.

DETAILED DESCRIPTION

An embodiment of the present disclosure will be described below with reference to the drawings.

Figure 1:
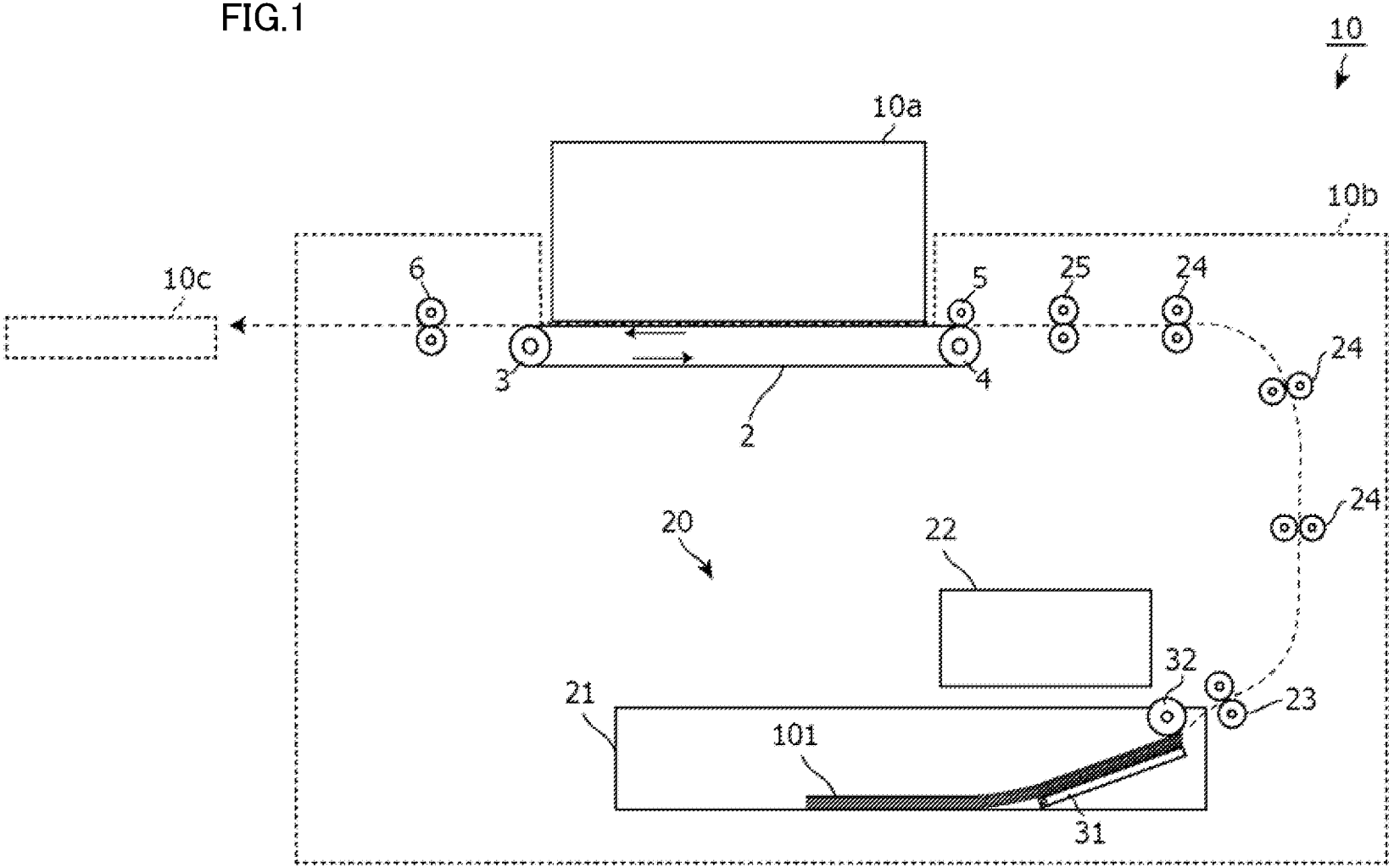
FIG. 1 is a side view illustrating a mechanical internal configuration of an image forming apparatus according to an embodiment of the present disclosure.

An image forming apparatus 10 according to an embodiment of the present disclosure includes a print engine 10*a* and a sheet conveying portion 10*b* (see FIG. 1). The print engine 10*a* physically prints an image to be printed on a sheet. The sheet is paper or the like.

A color material cartridge can be attached to and detached from the print engine 10*a*. The color material cartridge is an ink cartridge, a toner cartridge, or the like. The print engine 10*a* performs printing using a color material supplied from the color material cartridge. The print engine 10*a* performs the printing using a predetermined method such as an inkjet method or an electrophotographic method. In addition, the sheet conveying portion 10*b* conveys a sheet 101 from the sheet feed apparatus 20 to the print engine 10*a*.

In the present embodiment, the sheet conveying portion 10*b* includes an annular conveying belt 2, a drive roller 3, a driven roller 4, a suction roller 5, and a discharge roller pair 6. The conveying belt 2 is arranged to face the print engine 10*a* and conveys a sheet 101. The conveying belt 2 is suspended on the drive roller 3 and the driven roller 4. The suction roller 5 sandwiches a sheet 101 together with the conveying belt 2.

The drive roller 3 and the driven roller 4 rotate the conveying belt 2. The suction roller 5 holds a sheet 101 conveyed from a sheet feed cassette 21 to be described later between the suction roller 5 and the conveying belt 2. Further, sheets 101 are sequentially conveyed to a print position of the print engine 10*a* by the conveying belt 2. The print engine 10*a* prints an image on a sheet 101 at the print position. A printed sheet 101 is discharged to a discharge tray 10*c* or the like by the discharge roller pair 6.

The sheet feed apparatus 20 includes a sheet feed cassette 21 and an air blowing device 22. The sheet feed cassette 21 can be attached to and detachable from the image forming apparatus 10. The sheet feed cassette 21 contains a stack of sheets 101.

In the sheet feed apparatus 20, a lift plate 31 pushes up the sheets 101, thereby bringing the sheets 101 into contact with a pickup roller 32. The sheets 101 loaded in the sheet feed cassette 21 are picked up one by one from the top by the pickup roller 32 to a sheet feed roller 23.

The sheet feed roller 23 feeds the picked up sheet 101 onto the conveying path. The air blowing device 22 can discharge warm air to a sheet stack in the sheet feed cassette 21. It is noted that, for example, the air blowing device 22 discharges warm air from any one of the upper side, the lower side, and the lateral side of the stack of sheets 101 toward the stack of sheets 101.

In addition, the conveying roller 24 conveys, along the conveying path, a sheet 101 fed from the sheet feed cassette 21. The resist roller 25 temporarily stops a sheet 101 being conveyed. Further, the resist roller 25 conveys the sheet 101 to the print position of the print engine 10*a* at a secondary sheet feed timing.

Figure 2:
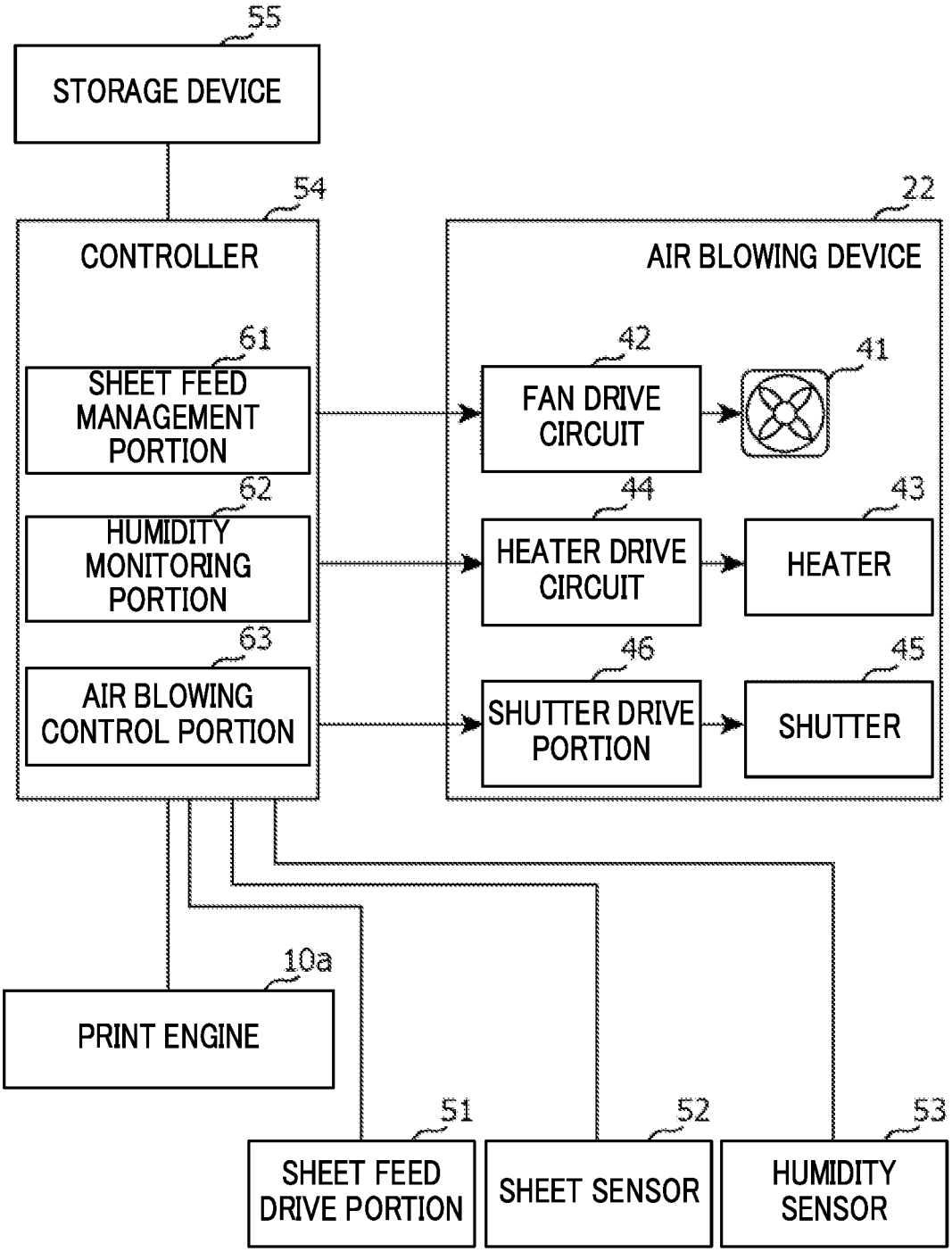
FIG. 2 is a block diagram showing an electrical configuration of the image forming apparatus according to the embodiment of the present disclosure.

As shown in FIG. 2, the image forming apparatus 10 further includes a sheet feed drive portion 51, a sheet sensor 52, a humidity sensor 53, a controller 54, and a storage device 55.

The sheet feed drive portion 51 is a power source for driving the pickup roller 32, the sheet feed roller 23, and the like. The sheet feed drive portion 51 includes, for example, a motor.

The sheet sensor 52 is a sensor for detecting the amount of sheets 101 loaded in the sheet feed cassette 21. The sheet sensor 52 is a contact type or non-contact type sensor for measuring the weight or thickness of a stack of sheets 101.

In the following description, the amount of sheets 101 loaded in the sheet feed cassette 21 will be referred to as a loaded sheet amount.

The number of loaded sheets 101 may be used as the loaded sheet amount. In this case, unit sheet information is set in advance by the user. The unit sheet information represents the weight or thickness per sheet 101 corresponding to the type of the sheet 101. The number of loaded sheets is derived based on the weight or thickness of the stack of sheets 101 measured by the sheet sensor 52 as well as the sheet information.

The humidity sensor 53 is a sensor for measuring the internal humidity inside the image forming apparatus 10 or the sheet feed apparatus 20.

The controller 54 controls internal devices of the image forming apparatus 10. The internal devices include the print engine 10*a*, the sheet conveying portion 10*b*, the sheet feed apparatus 20, and the like. The controller 54 is composed of a dedicated circuit such as an application specific integrated circuit (ASIC) or a microcomputer.

The storage device 55 is a nonvolatile storage device 55 such as a flash memory. The storage device 55 stores data necessary for controlling the air blowing device 22 to be described later, and the like.

In addition, as shown in FIG. 2, the air blowing device 22 includes an air blowing fan 41, a fan drive circuit 42, a heater 43, a heater drive circuit 44, a shutter 45, and a shutter drive portion 46.

Further, the air blowing device 22 has an exhaust port for discharging air sent from the air blowing fan 41 into the sheet feed cassette 21. The air blowing fan 41 sends air into the sheet feed cassette 21 through the exhaust port. The fan drive circuit 42 is a circuit for driving the air blowing fan 41.

The heater 43 heats air sent from the air blowing fan 41 to the sheet feed cassette 21, between the air blowing fan 41 and the exhaust port. Thus, the air blowing device 22 discharges warm air into the sheet feed cassette 21. The heater drive circuit 44 is a circuit for driving the heater 43. In the following description, the temperature of the air discharged from the air blowing device 22 will be referred to as a blown air temperature.

The shutter 45 is arranged at the exhaust port of the air blowing device 22. The shutter 45 adjusts the opening area of the exhaust port. The shutter drive portion 46 drives the shutter 45 by a motor or the like.

In addition, the controller 54 operates as a sheet feed management portion 61, a humidity monitoring portion 62, and an air blowing control portion 63.

The sheet feed management portion 61 controls the sheet feed drive portion 51 to operate the sheet feed apparatus 20.

The sheet feed management portion 61 causes the sheet feed apparatus 20 to execute a process of feeding a sheet 101 to the conveying path. The humidity monitoring portion 62 obtains an output signal of the humidity sensor 53 and constantly monitors the internal humidity based on the output signal. The air blowing control portion 63 controls the air blowing device 22 to adjust the volume of air discharged from the air blowing device 22 and the blown air temperature. In the following description, the volume of air discharged from the air blowing device 22 will be referred to as a blown air volume.

Meanwhile, the blown air temperature may be determined based on the sheet type, humidity, and temperature.

However, factors other than sheet type, humidity, and temperature may also cause sheets to be likely to stick to each other. Therefore, when the blown air temperature is determined based on the sheet type, humidity, and temperature, failure in sheet feeding may not be appropriately suppressed.

The air blowing control portion 63 controls the fan drive circuit 42 to adjust the rotation speed of the air blowing fan 41. Further, the air blowing control portion 63 controls the heater drive circuit 44 to adjust the amount of heat generated by the heater 43. Further, the air blowing control portion 63 controls the shutter drive portion 46 to adjust the opening degree of the shutter 45.

The air blowing control portion 63 controls the heater 43 to adjust the blown air temperature. Further, the air blowing control portion 63 controls one or both of the air blowing fan 41 and the shutter 45 to adjust the blown air volume.

Further, the air blowing control portion 63 identifies the amount of sheets 101 in the sheet stack based on the output signal of the sheet sensor 52. The air blowing control portion 63 adjusts the blown air volume and the blown air temperature in accordance with the identified amount of sheets 101. It is noted that the amount of sheets 101 in the sheet stack is the loaded sheet amount.

In the present embodiment, the air blowing control portion 63 adjusts the blown air volume and the blown air temperature also in accordance with a time parameter and a humidity parameter.

The time parameter represents a length of time elapsed from a point in time when a sheet stack is loaded in the sheet feed cassette 21. The elapsed time is measured by a timer (not shown).

The humidity parameter represents the maximum value of the internal humidity from a point in time when a sheet stack is loaded in the sheet feed cassette 21 to the present time. In the following description, the maximum value of the internal humidity from a point in time when a sheet stack is loaded in the sheet feed cassette 21 to the present time will be referred to as the maximum internal humidity. The humidity monitoring portion 62 stores the maximum internal humidity in the storage device 55.

For example, the air blowing control portion 63 applies the loaded sheet amount, the time parameter, and the humidity parameter to a predetermined calculation formula or a look-up table to derive a value of a warm air control variable.

Further, the air blowing control portion 63 adjusts the blown air volume and the blown air temperature in accordance with the value of the warm air control variable.

In the following description, the point in time when the sheet stack is loaded in the sheet feed cassette 21 will be referred to as a control reference time point. In addition, the number of sheets 101 at the control reference time point will be referred to as a starting number of sheets.

For example, the sheet feed management portion 61 sets a sheet number coefficient to 1 when the starting number of sheets is less than or equal to 1000. In addition, the sheet feed management portion 61 sets the sheet number coefficient to 2 when the starting number of sheets is more than 1000 and less than or equal to 2000. In addition, the sheet feed management portion 61 sets the sheet number coefficient to 3 when the starting number of sheets is more than 2000 and less than or equal to 3000. In addition, the sheet feed management portion 61 sets the sheet number coefficient to 4 when the starting number of sheets is more than 3000 and less than or equal to 4000. The sheet number coefficient is an example of the loaded sheet amount.

In addition, for example, the humidity monitoring portion 62 adds 0.1 to the time coefficient every time the elapsed time increases by 10 minutes. The initial value of the time coefficient is 0. The time coefficient is an example of the time parameter.

In addition, for example, the humidity monitoring portion 62 sets a humidity coefficient to 0 when the maximum internal humidity is 0%. In addition, the humidity monitoring portion 62 sets the humidity coefficient to 0.1 when the maximum internal humidity is more than 0% and less than or equal to 10%. In addition, the humidity monitoring portion 62 sets the humidity coefficient to 0.2 when the maximum internal humidity is more than 10% and less than or equal to 20%. Similarly, when the maximum internal humidity is more than $((n-1)\times10)\%$ and less than or equal to $(n\times10)\%$, the humidity monitoring portion 62 sets the humidity coefficient to n/10. It is noted that n is an integer more than or equal to 2 and less than or equal to 10. The humidity coefficient is an example of the humidity parameter.

Then, the air blowing control portion 63 derives the sum of the sheet number coefficient, the time coefficient, and the humidity coefficient as the value of the warm air control variable.

Accordingly, the larger the loaded sheet amount, the larger the value set for the warm air control variable. In addition, the longer the elapsed timer, the larger the value set for the warm air control variable. In addition, the higher the maximum internal humidity, the larger the value set for the warm air control variable. Also, the larger the value of the warm air control variable, the higher the blown air temperature is set due to an increase in the amount of heat generated by the heater 43 or a decrease in the blown air volume.

FIG. 3 shows an example of a look-up table showing a correspondence relationship between the value of the warm air control variable, a heater duty, and an air volume ratio.

The heater duty is a duty of pulsed power feeding when the amount of heat generated by the heater 43 is adjusted by chopper control. The heater duty represents the amount of heat generated by the heater 43.

The air volume ratio is the ratio of the blown air volume to the maximum air volume of the air blowing device 22. The air volume ratio represents the magnitude of the blown air volume.

It is noted that the look-up table is stored in advance in the storage device 55 and read by the air blowing control portion 63 as appropriate.

For example, as shown in FIG. 3, the heater duty and the air volume rate are adjusted so that the larger the value of the warm air control variable, the higher the blown air temperature.

Next, an operation of the sheet feed apparatus 20 will be described.

The sheet feed management portion 61 controls the sheet feed drive portion 51 in accordance with a print job or the like. Thus, the sheet feed management portion 61 causes the sheet feed apparatus 20 to execute a process of feeding sheets 101 one by one. The air blowing control portion 63 controls the air blowing device 22 to cause the air blowing device 22 to discharge warm air toward a stack of sheets 101. The warm air is discharged so that sheets 101 can be smoothly fed.

The air blowing control portion 63 detects a sheet empty based on an output signal of the sheet sensor 52. Further, the air blowing control portion 63 detects sheet replenishment based on an output signal of the sheet sensor 52 after the sheet empty is detected. The sheet replenishment means that sheets 101 are loaded in the sheet feed cassette 21.

The air blowing control portion 63 identifies, as the control reference time point, a point in time when the sheet replenishment is detected after the sheet empty is detected. The air blowing control portion 63 resets the sheet number coefficient, the time coefficient, and the humidity coefficient to the initial values at the control reference time point.

Thereafter, the air blowing control portion 63 monitors the elapsed time from the control reference time point to the present time and the maximum internal humidity in the period from the control reference time point to the present time.

The air blowing control portion 63 updates the time coefficient and the humidity coefficient at each adjustment timing after the control reference time point. The adjustment timing is one or both of a fixed cycle timing and a timing when a predetermined event occurs. The fixed cycle is, for example, 10 minutes. Further, the air blowing control portion 63 updates the value of the warm air control variable based on the updated time coefficient and humidity coefficient.

It is noted that the air blowing control portion 63 stores information such as the control reference time point and the maximum internal humidity in the storage device 55. The air blowing control portion 63 reads information such as the control reference time point and the maximum internal humidity from the storage device 55 as necessary.

Further, the air blowing control portion 63 identifies the heater duty, the rotation speed of the air blowing fan 41, and the opening degree of the shutter 45 corresponding to the updated value of the warm air control variable. The air blowing control portion 63 identifies the heater duty, the rotation speed of the air blowing fan 41, and the opening degree of the shutter 45 with reference to a look-up table or the like stored in advance in the storage device 55 or the like.

Further, the air blowing control portion 63 controls the heater drive circuit 44, the fan drive circuit 42, and the shutter drive portion 46 so as to realize the identified heater duty, rotation speed of the air blowing fan 41, and opening degree of the shutter 45.

By the air blowing control portion 63 executing the above-described control, warm air having the blown air volume and the blown air temperature corresponding to the value of the warm air control variable is sent from the air blowing device 22 to a stack of sheets 101 in the sheet feed cassette 21. In the present embodiment, warm air of the air blowing device 22 is mainly sent to the leading end portion in a sheet feeding direction of a stack of sheets 101 in the sheet feed cassette 21.

Figure 4:
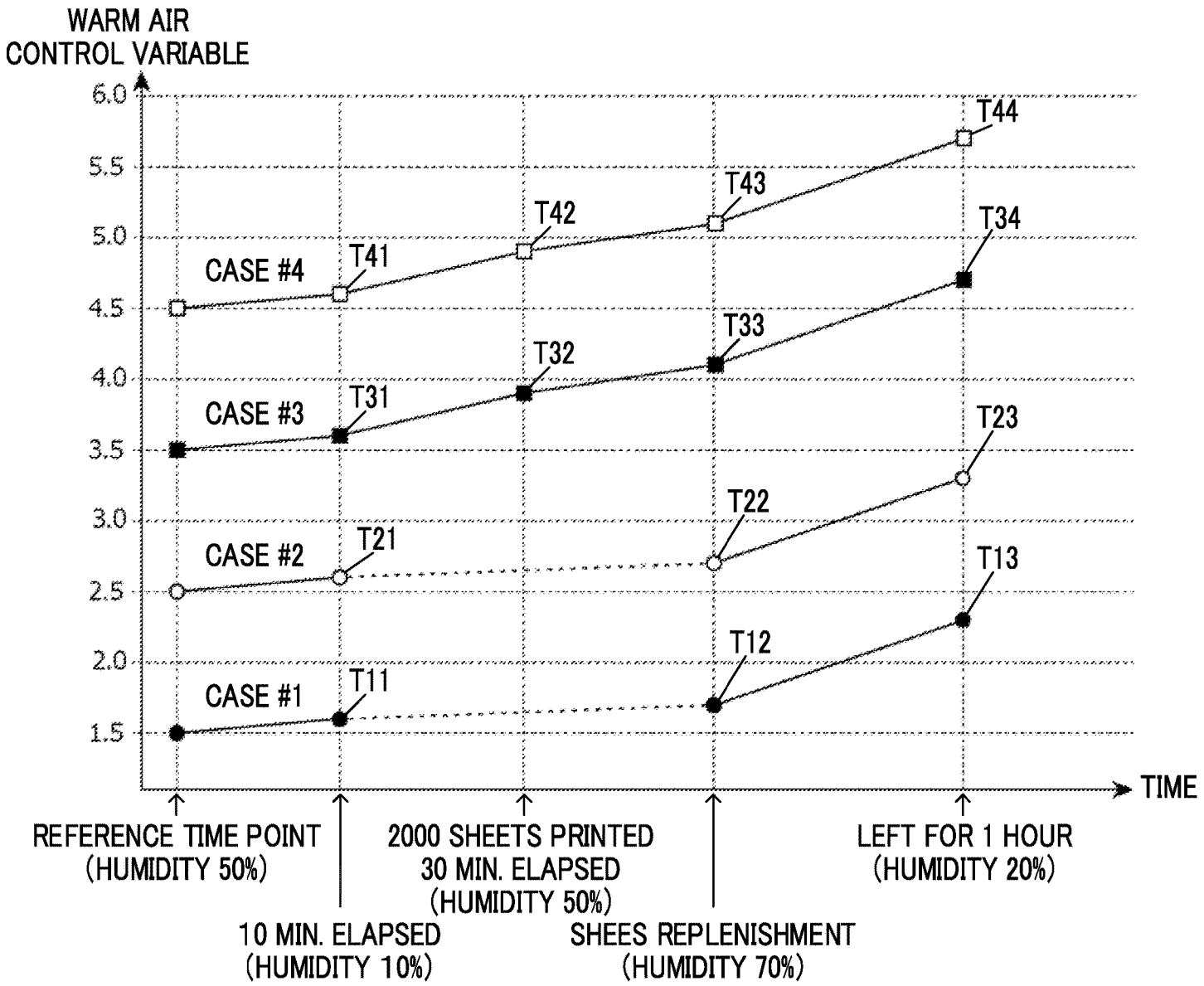
FIG. 4 illustrates an example of transition of the value of the warm air control variable.

FIG. 4 illustrates an example of transition of the value of the warm air control variable. FIG. 4 shows transition of the value of the warm air control variable in each of four cases. The four cases are case #1, case #2, case #3, and case #4.

At the control reference time point in the case #1, the starting number of sheets is more than or equal to 1 and less than or equal to 1000, and the humidity is 50%. Further, at the control reference time point in the case #1, the sheet number coefficient is 1, the humidity coefficient is 0.5, and the time coefficient is 0. Accordingly, at the control reference time point in the case #1, the value of the warm air control variable is 1.5 (=1+0.5+0).

A first time point T11 in the case #1 is a point in time when 10 minutes have elapsed from the control reference time point. The maximum internal humidity at the first time point T11 is 50%. In addition, at the first time point T11, the humidity coefficient is 0.5 and the time coefficient is 0.1. Accordingly, the value of the warm air control variable at the first time point T11 is 1.6 (=1+0.5+0.1).

A second time point T12 in the case #1 is a point in time when sheet replenishment is performed after the first time point T11. The sheet replenishment is performed when the sheet empty is detected as all sheets in the cassette 21 having been fed out by printing. In the sheet replenishment, the same amount of sheets 101 as the amount of sheets 101 at the control reference time point is replenished.

The humidity at the second time point T12 is 70%. Therefore, at the second time point T12, the sheet number coefficient is 1, the humidity coefficient is 0.7, and the time coefficient is 0. Accordingly, the value of the warm air control variable at the second time point T12 is 1.7 (=1+0.7+0).

A third time point T13 in the case #1 is a point in time when the image forming apparatus 10 has been left for one hour from the second time point T12. The maximum internal humidity at the third time point T13 is 70%. Therefore, at the third time point T13, the humidity coefficient is 0.7 and the time coefficient is 0.6. Accordingly, the warm air control variable at the third time point T13 is 2.3 (=1+0.7+0.6).

It is noted that a fourth time point in the case #1 is not shown in FIG. 4. The fourth time point in the case #1 is a point in time when the image forming apparatus 10 has been left for 24 hours from the third time point T13. At the fourth time point in the case #1, the maximum internal humidity is 70%, the humidity coefficient is 0.7, and the time coefficient is 15.0. Accordingly, at the fourth time point in the case #1, the value of the warm air control variable is 16.7 (=1+0.7+15.0).

In addition, at the control reference time point in the case #2, the starting number of sheets is more than 1000 and less than or equal to 2000, and the humidity is 50%. Further, at the control reference time point in the case #2, the sheet number coefficient is 2, the humidity coefficient is 0.5, and the time coefficient is 0. Accordingly, at the control reference time point in the case #2, the value of the warm air control variable is 2.5 (=2+0.5+0).

A first time point T21 in the case #2 is a point in time when 10 minutes have elapsed from the control reference time point. The maximum internal humidity at the first time point T21 is 50%. In addition, at the first time point T21, the humidity coefficient is 0.5 and the time coefficient is 0.1. Accordingly, the value of the warm air control variable at the first time point T21 is 2.6 (=2+0.5+0.1).

A second time point T22 in the case #2 is a point in time when sheet replenishment is performed after the first time point T21. In the sheet replenishment, the same amount of sheets 101 as the amount of sheets 101 at the control reference time point is replenished.

The humidity at the second time point T22 is 70%. Therefore, at the second time point T22, the sheet number coefficient is 2, the humidity coefficient is 0.7, and the time coefficient is 0. Accordingly, the value of the warm air control variable at the second time point T22 is 2.7 (=2+0.7+0).

A third time point T23 in the case #2 is a point in time when the image forming apparatus 10 has been left for one hour from the second time point T22. The maximum internal humidity at the third time point T23 is 70%. Therefore, at the third time point T23, the humidity coefficient is 0.7 and the time coefficient is 0.6. Accordingly, the value of the warm air control variable at the third time point T23 is 3.3 (=2+0.7++0.6).

It is noted that a fourth time point in the case #2 is not shown in FIG. 4. The fourth time point in the case #2 is a point in time when the image forming apparatus 10 has been left for 24 hours from the third time point T23. At the fourth time point in the case #2, the maximum internal humidity is 70%, the humidity coefficient is 0.7, and the time coefficient is 15.0. Accordingly, at the fourth time point in the case #2, the warm air control variable is 17.7 (=2+0.7+15.0).

At the control reference time point in the case #3, the starting number of sheets is more than 2000 and less than or equal to 3000, and the humidity is 50%. Further, at the control reference time point in the case #3, the sheet number coefficient is 3, the humidity coefficient is 0.5, and the time coefficient is 0. Accordingly, at the control reference time point in the case #3, the value of the warm air control variable is 3.5 (=3+0.5+0).

A first time point T31 in the case #3 is a point in time when 10 minutes have elapsed from the control reference time point. The maximum internal humidity at the first time point T31 is 50%. In addition, at the first time point T31, the humidity coefficient is 0.5 and the time coefficient is 0.1. Accordingly, the value of the warm air control variable at the first time point T31 is 3.6 (=3+0.5+0.1).

A second time point T32 in the case #3 is a point in time when 2000 sheets in the cassette 21 have been fed out by printing after the first time point T31 and 30 minutes have elapsed from the first time point T31. At the second time point T32, the sheet empty is not detected.

The humidity at the second time point T32 is 50%. At the second time point T32, the humidity coefficient is 0.5 and the time coefficient is 0.4. Therefore, the warm air control variable at the second time point T32 is 3.9 (=3+0.5+0.4).

A third time point T33 in the case #3 is a point in time when the sheet replenishment is performed immediately after the second time point T32. In the sheet replenishment, the same amount of sheets 101 as the amount of sheets 101 at the control reference time point is replenished.

The humidity at the third time point T33 is 70%. Therefore, the humidity coefficient and the time coefficient are not reset at the third time point T33. In addition, at the third time point T33, the humidity coefficient is 0.7 and the time coefficient is 0.4. Accordingly, the value of the warm air control variable at the third time point T33 is 4.1 (=3+0.7+0.4).

A fourth time point T34 in the case #3 is a point in time when the image forming apparatus 10 has been left for one hour from the third time point T33. The maximum internal humidity at the fourth time point T34 is 70%. Therefore, at the fourth time point T34, the humidity coefficient is 0.7 and the time coefficient is 1.0. Accordingly, the value of the warm air control variable at the fourth time point T34 is 4.7 (=3+0.7+1.0).

It is noted that a fifth time point in the case #3 is not shown in FIG. 4. The fifth time point in the case #3 is a point in time when the image forming apparatus 10 has been left for 24 hours from the fourth time point T34. At the fifth time point in the case #3, the maximum internal humidity is 70%, the humidity coefficient is 0.7, and the time coefficient is 15.4. Accordingly, the value of the warm air control variable at the fifth time point in the case #3 is 19.1 (=3+0.7+15.4).

At the control reference time point in the case #4, the starting number of sheets is more than 3000 and less than or equal to 4000, and the humidity is 50%. Further, at the control reference time point in the case #4, the sheet number coefficient is 4, the humidity coefficient is 0.5, and the time coefficient is 0. Accordingly, at the control reference time point in the case #4, the value of the warm air control variable is 4.5 (=4+0.5+0).

A first time point T41 in the case #4 is a point in time when 10 minutes have elapsed from the control reference time point. The maximum internal humidity at the first time point T41 is 50%. In addition, at the first time point T41, the humidity coefficient is 0.5 and the time coefficient is 0.1. Accordingly, at the first time point T41, the value of the warm air control variable is 4.6 (=4+0.5+0.1).

A second time point T42 in the case #4 is a point in time when 2000 sheets in the cassette 21 have been fed out by printing after the first time point T41 and 30 minutes have elapsed from the first time point T41. At the second time point T42, the sheet empty is not detected.

The humidity at the second time point T42 is 50%. At the second time point T42, the humidity coefficient is 0.5 and the time coefficient is 0.4. Accordingly, the value of the warm air control variable at the second time point T42 is 4.9 (=4+0.5+0.4).

A third time point T43 in the case #4 is a point in time when the sheet replenishment is performed immediately after the second time point T42. In the sheet replenishment, the same amount of sheets 101 as the amount of sheets 101 at the control reference time point is replenished.

The humidity at the third time point T43 is 70%. Therefore, the humidity coefficient and the time coefficient are not reset at the third time point T43. At the third time point T43, the humidity coefficient is 0.7 and the time coefficient is 0.4. Accordingly, the value of the warm air control variable at the third time point T43 is 5.1 (=4+0.7+0.4).

A fourth time point T44 in the case #4 is a point in time when the image forming apparatus 10 has been left for one hour from the third time point T43. The maximum internal humidity at the fourth time point T44 is 70%. Therefore, at the fourth time point T44, the humidity coefficient is 0.7 and the time coefficient is 1.0. Accordingly, the value of the warm air control variable at the fourth time point T44 is 5.7 (=4+0.7+1.0).

It is noted that a fifth time point in the case #4 is not shown in FIG. 4. The fifth time point in the case #4 is a point in time when the image forming apparatus 10 has been left for 24 hours from the fourth time point T44. At the fifth time point in the case #4, the maximum internal humidity is 70%, the humidity coefficient is 0.7, and the time coefficient is 15.4. Accordingly, the value of the warm air control variable at the fifth time point in the case #4 is 20.1 (=4+0.7+15.4).

As described above, the larger the loaded sheet amount at the control reference time point, the larger the value of the warm air control variable is set. Further, the higher the maximum internal humidity, the larger the value of the warm air control variable is set. Further, the longer the elapsed time from the control reference time point, the larger the value of the warm air control variable is set.

Accordingly, the larger the loaded sheet amount at the control reference time point, the higher the blown air temperature is set. Further, the higher the maximum internal humidity, the higher the blown air temperature is set. Further, the longer the elapsed time from the control reference time point, the higher the blown air temperature is set. As a result, the sticking of sheets 101 to each other caused by the loaded sheet amount is appropriately suppressed.

As described above, the air blowing device 22 blows warm air to a sheet stack in the sheet feed cassette 21. The air blowing control portion 63 controls the air blowing device 22 to adjust the blown air volume and the blown air temperature. The air blowing control portion 63 adjusts the blown air volume and the blown air temperature in accordance with the amount of sheets 101 in the sheet stack.

When the amount of sheets 101 in the sheet feed cassette 21 is large, the sheets 101 stick to each other due to the weight of the sheets 110; therefore, failure in sheet feeding is likely to occur. In the present embodiment, the blown air volume and the blown air temperature are adjusted in accordance with the amount of sheets 101 in the sheet feed cassette 21. As a result, the failure in sheet feeding caused by the amount of sheets 101 is appropriately suppressed.

It is noted that various changes and modifications to the present embodiment will be obvious to those skilled in the art. Such changes and modifications may be made without departing from the intent and scope of the subject matter in the present embodiment and without diminishing the intended advantages. That is, it is intended in advance that applications in which such changes and modifications have been made to the present embodiment are included in the scope of the claims.

For example, in the present embodiment, first, when the blown air temperature is a certain temperature, the opening degree of the shutter 45 may be set to a certain opening degree, and then the rotation speed of the air blowing fan 41 may be set in accordance with the opening degree of the shutter 45.

The smaller the opening degree of the shutter 45, the smaller the opening area of the exhaust port of the air blowing device 22 and the faster the wind velocity of the warm air. The higher the wind velocity of the warm air, the easier it is for the loaded sheets 101 to be separated from each other by the wind pressure.

On the other hand, the larger the opening degree of the shutter 45, the larger the opening area of the exhaust port of the air blowing device 22 and the slower the wind velocity of the warm air. The slower the wind velocity of the warm air, the more a wide area around the sheets 101 is heated. As a result, the sheet feed apparatus 20 is dehumidified.

Accordingly, as described above, the opening degree of the shutter 45 may be set with priority in accordance with the sheet type or humidity, and the rotation speed of the air blowing fan 41 may be set in accordance with the opening degree of the shutter 45. In this case, the rotation speed of the air blowing fan 41 is set so that the blown air temperature becomes a target temperature. For example, when the sheet type is coated paper, the stack of sheets 101 is more likely to stick to each other as the humidity increases. At this time, the opening degree of the shutter 45 is set to a large opening degree, and the sheet feed apparatus 20 is dehumidified due to the slow wind velocity of the warm air.

The present disclosure can be applied to an image forming apparatus such as a printer or a multifunction peripheral.

It is to be understood that the embodiments herein are illustrative and not restrictive, since the scope of the disclosure is defined by the appended claims rather than by the description preceding them, and all changes that fall within metes and bounds of the claims, or equivalence of such metes and bounds thereof are therefore intended to be embraced by the claims.

The invention claimed is:

1. A sheet feed apparatus comprising:

a sheet feed cassette;

an air blowing device configured to blow warm air to a sheet stack in the sheet feed cassette; and an air blowing control portion configured to control the air blowing device to adjust an air volume and a temperature of the warm air, wherein the air blowing control portion adjusts the air volume and the temperature of the warm air in accordance with an amount of sheets in the sheet feed cassette, and the air blowing control portion adjusts the air volume and the temperature of the warm air also in accordance with an elapsed time from a point in time when the sheet stack is loaded in the sheet feed cassette.

2. A sheet feed apparatus comprising:

a sheet feed cassette;

an air blowing device configured to blow warm air to a sheet stack in the sheet feed cassette; and an air blowing control portion configured to control the air blowing device to adjust an air volume and a temperature of the warm air, wherein the air blowing control portion adjusts the air volume and the temperature of the warm air in accordance with an amount of sheets in the sheet feed cassette, and the air blowing control portion adjusts the air volume and the temperature of the warm air also in accordance with a maximum value of internal humidity from a point in time when the sheet stack is loaded in the sheet feed cassette to a present time.

3. The sheet feed apparatus according to claim 1, wherein the air blowing device includes: an air blowing fan; an exhaust port for discharging air sent from the air blowing fan into the sheet feed cassette; a shutter arranged at the exhaust port; and a heater for heating the air between the air blowing fan and the exhaust port, the air blowing control portion controls the heater to adjust the temperature of the warm air, and the air blowing control portion further controls one or both of the air blowing fan and the shutter to adjust the air volume of the warm air.

4. An image forming apparatus comprising:

the sheet feed apparatus according to claim 1; and a print engine, wherein the sheet feed apparatus feeds one sheet at a time from the sheet stack in the sheet feed cassette into a conveying path, and the print engine prints an image on the sheet conveyed through the conveying path.

5. An image forming apparatus comprising:

the sheet feed apparatus according to claim 3; and a print engine, wherein the sheet feed apparatus feeds one sheet at a time from the sheet stack in the sheet feed cassette into a conveying path, and the print engine prints an image on the sheet conveyed through the conveying path.

* * * * *